United States Patent [19]

Couture

[11] 4,109,872

[45] Aug. 29, 1978

[54] PULPING APPARATUS FOR LIQUID SLURRY STOCK

[75] Inventor: Joseph Walter Couture, Dorval, Canada

[73] Assignee: The Black Clawson Company, Middletown, Ohio

[21] Appl. No.: 820,089

[22] Filed: Jul. 29, 1977

[51] Int. Cl.[2] ..... B02C 23/36

[52] U.S. Cl. ..... 241/46.11; 241/46.17

[58] Field of Search ..... 241/46.11, 46.17

[56] References Cited

U.S. PATENT DOCUMENTS

| | | | |
|---|---|---|---|
| 3,073,535 | 1/1963 | Vokes | 241/46.11 |
| 3,486,702 | 12/1969 | Kmeco | 241/46.17 |
| 3,843,063 | 10/1974 | Honeyman | 241/46.11 |
| 3,889,885 | 6/1975 | Couture | 241/46.17 |

*Primary Examiner*—Granville Y. Custer, Jr.
*Attorney, Agent, or Firm*—Biebel, French & Nauman

[57] ABSTRACT

A rotor for a pulper for liquid slurry stock includes a rotor body provided with circumferentially spaced composite vanes, each of which includes a defibering portion and a pumping portion. The defibering portion constitutes the outer end portion of each vane and is of relatively small axial dimensions. The pumping portion constitutes the upper portion of each composite vane and is of substantially greater axial dimensions with its upper surface of convex airfoil shape. The leading face of each pumping portion is essentially plane and inclined forwardly to overhang the trailing edge of the adjacent pumping portion and define therewith a groove in which the stock is channeled for forced centrifugally outward flow. In the preferred embodiment, the rotor cooperates with a frustoconical extraction plate, and the defibering vane portions have their undersurfaces inclined to match the inclination of the extraction plate and are proportioned to extend fully across the extraction plate.

10 Claims, 9 Drawing Figures

PULPING APPARATUS FOR LIQUID SLURRY STOCK

BACKGROUND OF THE INVENTION

This invention relates to pulping apparatus for liquid slurry stocks such as paper making stock, and more particularly to rotors for use in such pulping apparatus.

The invention has special relation to pulping apparatus of the type wherein the stock to be pulped is contained in a tub which is provided with a rotor or impeller mounted in the bottom or side wall thereof for rotation on an axis causing outward circulatory movement of the stock in a generally vortical pattern which creates hydraulic shearing forces in the stock and thereby effects the desired pulping or defibering action. Pulping apparatus of this general type is employed in both batch and continuous operations, and the invention is equally applicable to both types of operation.

In the experience of the present inventor, the rotors having the most effective defibering action for the uses outlined above were for a period of about 15 years constructed in accordance with Vokes U.S. Pat. No. 3,073,535. As pointed out in that patent, however, the pumping action of the rotor is provided only by the leading edge surfaces of its vanes and is therefore maintained in close proximity to the cooperating bedplate. As a result, the defibering action, which is caused both by hydraulic shear in the zone above the rotor and by mechanical action between the rotor and bedplate, is extremely effective, but only a relatively small volume of stock is subjected to this action during any given time interval, and the power requirements for adequate treatment of a given batch or for a given period of continuous operation are relatively high.

Another result of the limited pumping action of the rotors of the Vokes patent construction is that because it is primarily confined to the vicinity of the bedplate, it may not develop a complete vortex in the stock above the rotor, especially if the liquid level is relatively high. This in turn can lead to a tendency for floating material to remain on or near the surface of the stock without reaching the vicinity of the rotor for subjection to its defibering action.

The rotors disclosed in my U.S. Pat. No. 3,889,885 were developed to offer improvement over those of the Vokes patent in two respects — the thickness of the defibering vanes of the rotor was reduced to minimize their pumping action, and pumping vanes were provided on the upper surfaces of certain of the defibering vanes to increase the vortical circulation effect created by the rotor in operation. It has been established in many installations that a rotor constructed in accordance with that patent requires substantially less horsepower per ton, for either batch or continuous operation, than a rotor of the same diameter constructed in accordance with the Vokes patent, to produce substantially the same effective defibering action on any of a wide variety of furnishes, ranging from clean broke or pulp lap to waste paper of low and dirty grades, and at any handleable consistency.

SUMMARY OF THE INVENTION

Although the rotors of my U.S. Pat. No. 3,889,885 offer substantially practical advantages over all previously available rotors, it is still possible to improve on their performance, by means of the rotors of the present invention described hereinafter. Briefly stated, the object of the present invention is to provide a rotor for a pulper for liquid slurry stock which includes the pumping ability of the rotor of my U.S. Pat. No. 3,889,885 but is even more effective and efficient in defibering and the use of horsepower.

The principles of the present invention can best be explained in connection with the description of the preferred embodiment, but they can be summarized as involving changing the construction of the pumping vanes of my prior rotor to increase their efficiency and also the effectiveness of the rotor as a whole in developing a complete vortex in the pulper tub, and thereby assuring that all furnish added to the tub is immersed in liquid virtually immediately and thereafter is continuously circulated throughout the tub for rapid defibering.

The invention is also characterized by a new cooperative relation between the rotor and its associated extraction plate, which is especially desirable in a continuous pulping operation, in that the extraction plate is frustoconical, and the defibering vanes of the rotor have complementary upwardly tilted bottom surfaces which overlie the extraction plate and keep it continually free of plastic and other materials which could seal off the extraction holes therethrough.

These and other objects and advantages of the invention are pointed out in more detail in the course of the description of the preferred embodiment hereinafter.

DESCRIPTION OF THE PREFERRED EMBODIMENT

Figure 1:
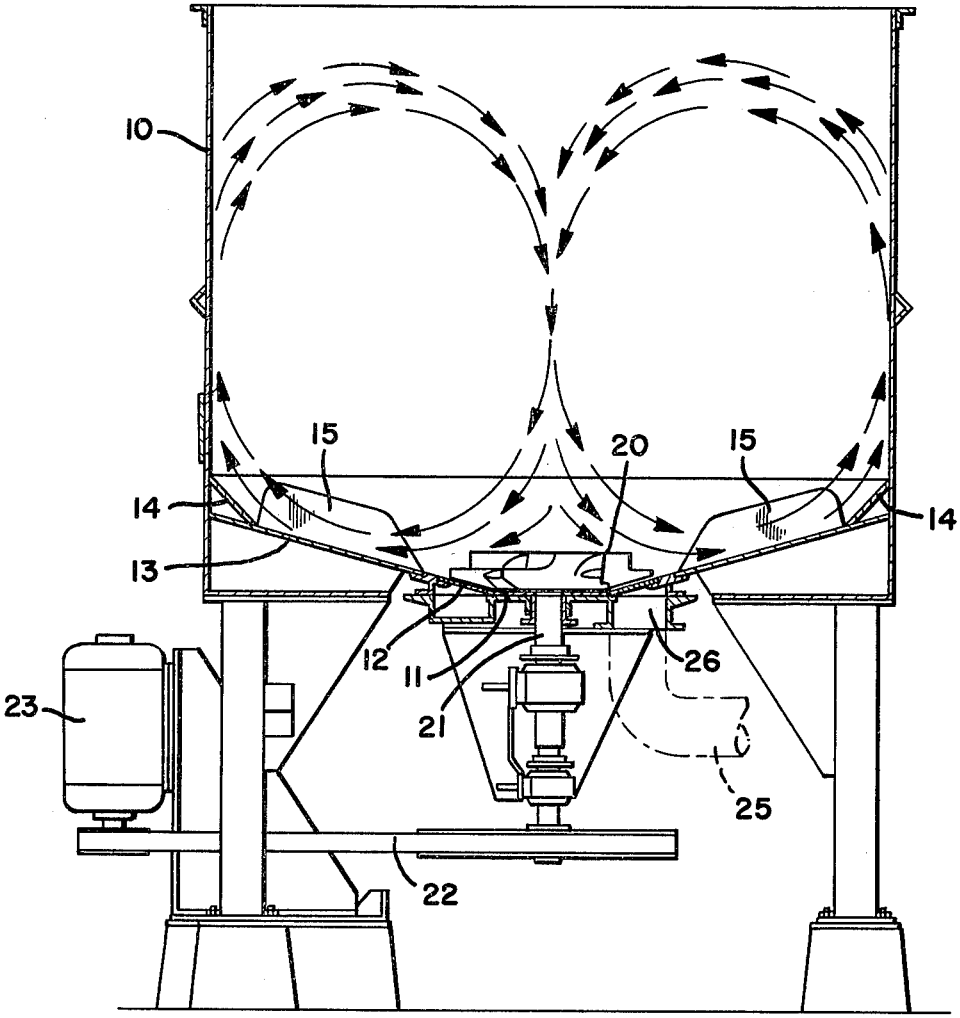
FIG. 1 is a somewhat diagrammatic view generally in vertical section showing a pulper and rotor incorporating the present invention.

The pulper illustrated in FIG. 1 includes a tub having a cylindrical upper wall 10, and a bottom wall comprising a plane center section 11 surounded by a frustoconical perforate extraction plate 12, which is in turn surrounded by an imperforate frustoconical portion 13 tapered at the same angle as the extraction plate. A further more steeply angled frustoconical imperforate portion 14 extends from the outer ends of the stationary guide plates 15 into contact with the cylindrical wall 10.

The rotor 20 is mounted for rotation on a vertical shaft 21 in centered and closely spaced relation with the bottom wall portion 11, and it is shown as provided with a belt and pulley drive 22 from a motor 23. A pipe 25 leads from the annular chamber 26 immediately below the perforate extraction plate 12 for conducting away the stock extracted through the perforations in the extraction plate.

Figure 8:
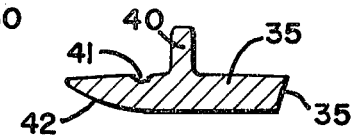
FIG. 8 is a section on the line 8—8 of FIG. 7.
Figure 9:
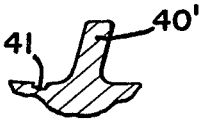
FIG. 9 is a fragmentary view similar to FIG. 8 but showing a modified construction.

The present invention is concerned particularly with the construction of the rotor 20 and its cooperative relation with the tapered extraction plate 12. The novel characteristics and advantages of the rotor can best be explained against the background of a brief description of a rotor of my patent No. 3,889,885 such as is shown in FIGS. 7–9.

Figure 7:
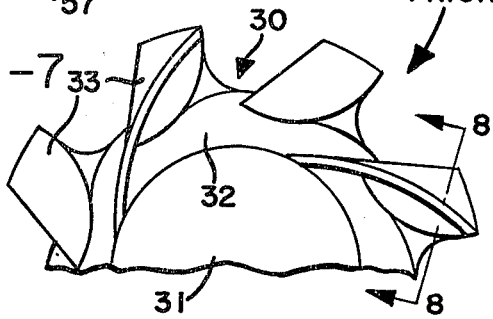
PRIOR ART FIG-7
FIG. 7 is a fragmentary plan view of a rotor constructed in accordance with my U.S. Pat. No. 3,889,885.

In FIG. 7, the rotor body 30 includes a cover plate 31 and a vane ring 32 which supports a plurality of projecting vanes 33. As shown in FIG. 8, the thickness (axial dimension) of each vane 33 is relatively small, and its leading face 35 is forwardly inclined to define an angle of less than 90° (shown as 75°) with the cooperating extraction plate (not shown) which is comnonly flat and of substantially the same outer diameter as the rotor measured across its vanes 33. Each leading face 35 forms a relatively small angle (shown as 30°) with a radius to its outer end from the rotor axis, and the pumping efficiency of these vane faces 35 is therefore relatively low, maximum pumping efficiency requiring that this angle be close to 45°.

In order to increase the pumping efficiency of the rotor as described in my U.S. Pat. No. 3,889,885, pumping vanes 40 were provided on top of alternate vanes 33. Each of these pumping vanes is shown in FIG. 7 as to curved that a tangent to its outermost end and a radius to the same point from the rotor axis will define an angle substantially larger than 30°, and preferably as close as practicable to the 45° value at which a centrifugal pumping vane operates at highest efficiency. The pumping vanes 40 may be straight in vertical section as shown in FIG. 8, or may be tilted forwardly as shown at 40′ in FIG. 9.

Rotors constructed as described in my U.S. Pat. No. 3,889,885 as illustrated in FIGS. 7–9 have provided substantial advantages over the rotors of the Vokes patent in terms of reduced horsepower requirements for a given defibering operation. However, they also have certain disadvantageous characteristics which are corrected by the present invention. One is that as the pumping vanes 40 push the stock in their direction of rotation and centrifugally outwardly, i.e. to the right as viewed in FIGS. 8 and 9, a lower pressure zone develops on their trailing sides which induces a downward flow of stock just behind each pumping vane 40, i.e. on the lefthand side in FIGS. 8 and 9. One result of this operating characteristic has been found to be actual erosion of the top of the rotor along a line spaced closely behind each pumping vane 40, as indicated at 41.

Another disadvantageous characteristic also results from the low pressure zones which follow each of the pumping vanes 40. Since each of the pumping vanes 40 extends to the outer end of the trailing edge of its associated defibering vane 33, the space behind the outer end portion of its trailing side is open to the underlying extraction plate, and the downflow of stock induced by the low pressure zone is therefore directed against the top of the extraction plate. However, the trailing portion of the undersurface of the defibering vane is curved upwardly, as indicated at 42, to create a Bernoulli effect for the purpose of inducing upward flow of particles which might otherwise felt over the holes in the extraction plate. This upward flow is accentuated by bouncing of the downflow behind the pumping vane to such an extent that the resulting composite upward flow is too rapid and creates a lower pressure zone than is desirable in front of the next forwardly moving pumping vane, thereby tending to starve the pumping vanes.

Figure 3:
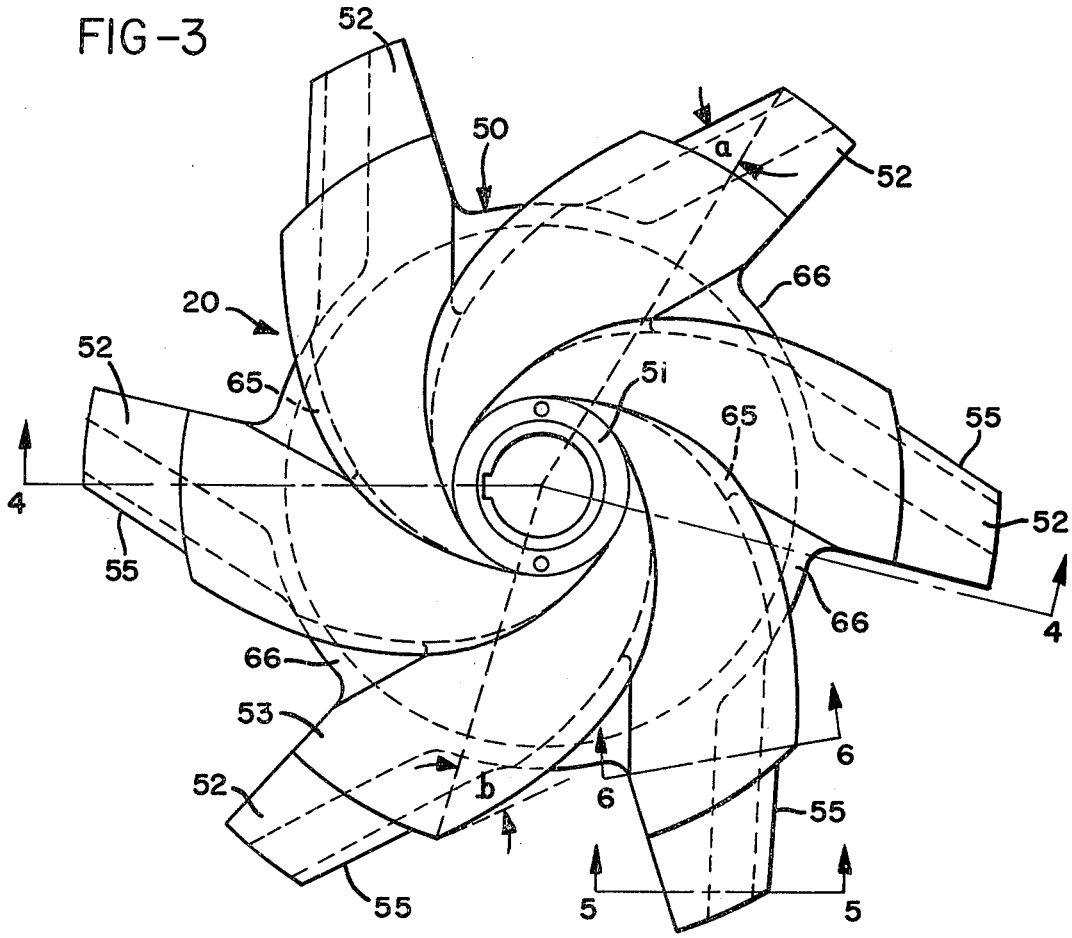
FIG. 3 is a plan view of the same rotor.

As previously noted, the rotor of the present invention has been developed to eliminate these characteristics which detract from the advantages of the rotor of my prior patent and to provide even greater defibering effectiveness and efficiency of operation. Referring first to FIG. 3, the rotor 20 constructed in accordance with the invention comprises a rotor body 50 having a hub portion 51, by which it is mounted on the shaft 21, and a plurality of composite vanes projecting outwardly from the hub portion 51 in angularly spaced relation and each including a defibering portion 52 and a pumping portion 53.

Figure 4:
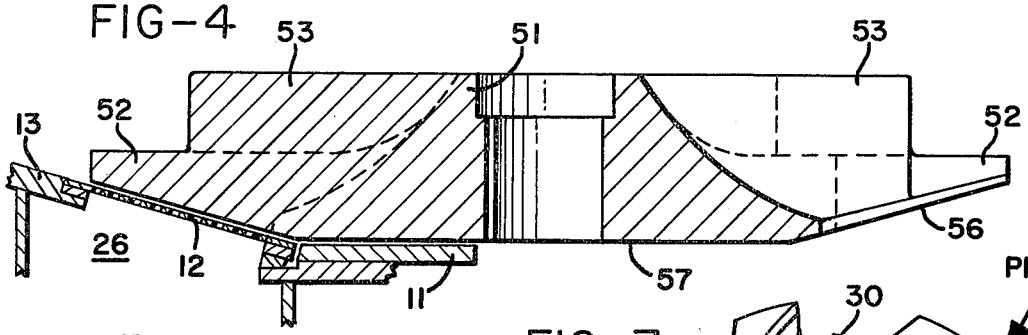
FIG. 4 is a section on the line 4—4 of FIG. 3 which also includes a fragment of the pulper tub bottom wall.
Figure 5:
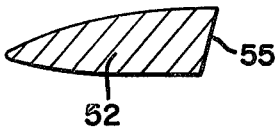
FIG. 5 is a section on the line 5—5 of FIG. 3.
Figure 6:
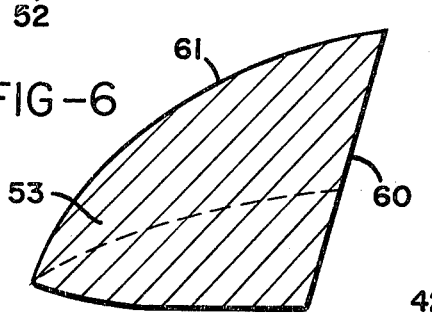
FIG. 6 is a section on the line 6—6 of FIG. 3.

The defibering portion 52 forms the radially outer end portion of each composite vane, and its thickness (axial dimension) is substantially less than that of the hub portion, as is best seen in FIG. 6 wherein the dotted line represents the projection of the top of the defibering portion 52. The pumping portion 53 constitutes the upper (axially outer) portion of each composite vane and has substantially smaller radial dimensions and substantially greater axial dimensions than the associated defibering portion 52, as is best illustrated in FIGS. 4 and 6.

Each defibering vane portion 52 has a plane leading face 55 which is inclined forwardly at approximately the same angle (15° off vertical) as the leading face 35 in FIG. 7. The leading face 55 is essentially straight from its outer end to the point at which it meets the body of the rotor and defines with a radius to its outer end an angle *a* of substantially less than 45°, shown as approximately 33°. In addition, the undersurface 56 of each vane portion 52 is inclined upwardly with respect to the plane undersurface 57 of the rotor body at the same angle as the frustoconical extraction plate 12, and as shown in FIG. 4, the vane portions 52 extend in overlying relation with the extraction plate 12 so that they sweep its entire area in operation.

The angle *a* is subject to considerable variation, depending upon the amount of pumping effect desired from the leading faces 55. Since they are the radially outermost working surfaces of the rotor, the power drawn by their pumping effect will increase in proportion to their diameter as the angle *a* increases, and from its standpoint, the preferred range for the angle *a* is approximately 20° to 35°.

The leading face 60 on each pumping vane portion 53 is also plane and forwardly inclined in section, and its radially outer end portion forms a continuation of the adjacent leading face 55. This outer portion of each leading face 60 is essentially straight, or curved as viewed in FIG. 3 about so long as radius that the angle *b* defined by a radius and a tangent to its outer end is sufficiently larger than angle *a* to increase the pumping effect, the angle *b* being shown in FIG. 3 as of approximately the optimum value of 45°. The radially inner part of each leading face 60 is generally spirally curved about decreasing radii as it approaches the hub portion 51 where its pumping effect becomes minimal.

As an illustrative example of the differences in dimensions of the rotor, in a rotor having an overall diameter of 42 inches, the diameter measured across the pumping vane portions 53 is 33 inches, and the diameter of the bottom of the rotor measured between defibering vane portions 52 is approximately 25 inches and substantially matches the outer diameter of the plane bottom wall portion 11. In addition, instead of the straight walled pumping vanes 40 of my prior patent, the upper surface 61 of each pumping vane portion 53 is convexly curved similarly to an airfoil to minimize the development of low pressure zones such as are created by the pumping vanes of my prior patent.

Figure 2:
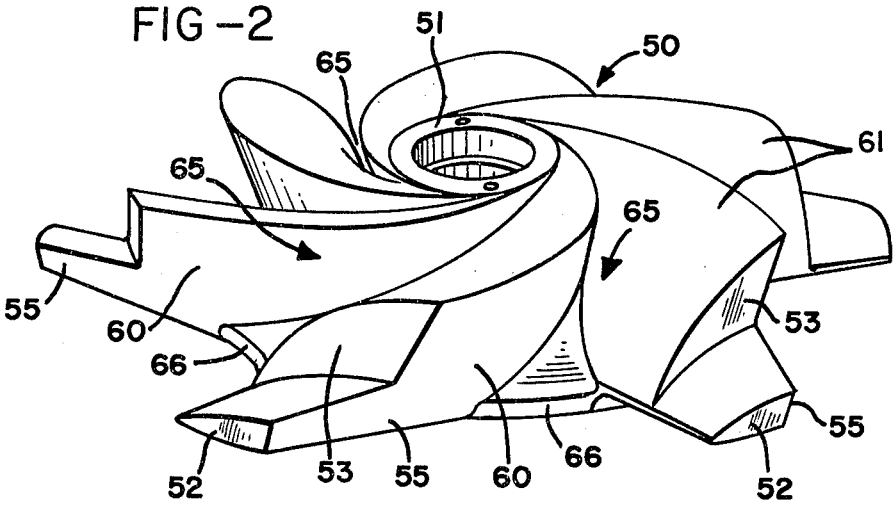
FIG. 2 is an isometric view of the rotor in the pulper of FIG. 1.

It will also be recognized, from FIGS. 2 and 3, that the construction of the respective vane portions as described results in causing the leading face 60 of each pumping vane portion to overhang the trailing edge of the upper surface 61 of the adjacent vane portion 53 in such manner that these two surfaces define a groove or canyon 65 in the top of the rotor which varies in depth and width from a minimum adjacent the hub portion 51 to a maximum at its outer end. In addition, the rotor body includes a web or skirt portion 66 of generally pie shape which forms a floor for the outer part of each canyon and also defines the outer periphery of the rotor body.

The result of this construction and arrangement is such that instead of producing downward currents which bounce off the extraction plate as in my prior patent, the pumping flow from each leading face 60 tends to be channeled in the adjacent canyon so that its direction of flow is primarily radially outwardly with a downward component for creation of effective vortical circulation within the tub. In other words, a downward flow along the top of each pumping vane portion will tend to be caught under the advancing adjacent face 60 and caused to flow centrifugally outwardly, and instead of bouncing upwardly as with the rotors of my prior patent, the flow is channeled under the forwardly inclined face 60 until it is discharged beyond the rotor.

The directions of flow imparted to the stock by the pumping vane portions 53 will therefore initially be essentially in planes normal to the rotor axis, thereby carrying the stock into the path of the defibering vane portions and also causing it to impinge on the perforate extraction plate. This initial effect is two fold — not only is there an increased tendency to clear the extraction plate of any materials tending to felt over its holes, but the angled impact of the stock against the plate, during both its initial outward travel and then such subsequent circulatory movement along the extraction plate as is imparted to it by the defibering vane portions 52, greatly increase the instances of impacting of stock against the edges of the extraction plate holes, thereby promoting rapid defibering.

The stock is then forced to change the angle of its direction, to the 15° to the horizontal defined by the extraction plate 12, while it is undergoing maximum defibering action and some pumping, rather than being defibered against the horizontal working surface of a bedplate as in the Vokes patent, and this angularly upward movement of the stock is continued smoothly by the tub bottom section 13 which has the same angle of taper as the extraction plate 12. This construction and mode of operation contribute important effects to the pumping and circulating efficiency of the rotor of the invention as compared with the prior rotors, as now described.

In particular, there is a relatively low degree of circumferential circulation or swirling of the stock in the tub, but there is a very high degree of vortical or vertical circulation. With the stock being forced to travel in the upwardly inclined directions defined by the extraction plate 12 and tub bottom section 13, it has a strong natural tendency to climb the cylindrical wall of the tub rather than to follow around the wall. As is represented by the pattern of arrows in FIG. 1, this in turn causes the stock to fall back toward the center vortex, so that given pieces of undefibered material will tend to follow the shortest paths back to the rotor for repeated treatment by both mechanical and hydraulic shear defibering forces developed by the rotor.

It is this rapid climbing and return movement of the stock which provides the pulper of the invention with its ability to immerse newly added furnish virtually immediately and to minimize the presence of floating material. An added advantage of these operating characteristics is the ability to handle high consistency stocks, for example consistencies as high as 10% solids in contrast with the 4–6% consistency range generally employed in pulpers equipped with conventional rotors.

The advantages provided by the invention in terms of both the power and the time required for a given defibering operation verge on the spectacular, e.g. reduction of both power and time by as much as one-third as compared with a pulper of the same size equipped with a rotor in accordance with the Vokes patent. Such tests indicate, for example, that a pulper 12 feet in diameter equipped with the rotor of the invention is at least equal in through-put capacity to a 14 foot pulper equipped with a conventional rotor even though the latter pulper tub would have approximately 35% higher volume.

While the form of apparatus herein described constitutes a preferred embodiment of the invention, it is to be understood that the invention is not limited to this precise form of apparatus, and that changes may be made therein without departing from the scope of the invention.

What is claimed is:

1. A rotor for use in pulping apparatus of the character described for liquid slurry stock including a tub for receiving a quantity of the stock and a perforated annular extraction plate forming a portion of a wall of the tub, comprising:

(a) a rotor body adapted to be mounted for rotation on the central axis thereof in predetermined direction in the tub in cooperative centered relation with the extraction plate and including a hub portion and a plurality of composite vanes projecting generally radially from said hub portion in circumferentially spaced relation, (b) each of said composite vanes including a defibering portion and a pumping portion, (c) said defibering portion constituting the radially outer end portion of said vane and having substantially smaller axial dimensions than said hub portion, (d) means forming an essentially plane leading face on each said defibering vane portion extending tangentially of said rotor body in said direction of rotation from a radius to the radially outer end thereof and defining with said radius an angle *a* of substantially less than 45°, (e) said pumping portion constituting the radially inner portion of each said composite vane but being of substantially lesser radial dimensions and substantially greater axial dimensions than said defibering portion, (f) means forming a leading face on each said pumping portion of such configuration as viewed axially of said rotor body that the angle *b* defined by a radius and a tangent to the outer end thereof is sufficiently larger than said angle *a* to promote efficient vortical circulation of the stock, and (g) said leading face on each of said pumping portions being plane in axial section and forwardly inclined into partially overhanging relation with the forwardly adjacent said pumping portion to define therewith a groove in the upper surface of said body.

2. A rotor assembly as defined in claim 1 wherein the upper surface of each said pumping portion has a convex curvature of airfoil configuration from the upper edge of said leading face to a minimum axial dimension at the radially outer end of the trailing edge thereof.

3. A rotor assembly as defined in claim 2 wherein the upper surface of each of said defibering vane portion varies from a maximum axial dimension along the leading edge thereof to a minimum axial dimension along the trailing edge thereof which substantially matches the minimum axial dimension of the adjacent said pumping portion, and wherein said leading face on each of said defibering vane portions forms a continuation of said leading face on the associated said pumping portion and is similarly forwardly inclined.

4. A rotor assembly as defined in claim 2 wherein the leading edges of said pumping portions diverge from said hub portion to the radially outer ends thereof to cause the axial depth of said grooves to vary from a minimum adjacent said hub portion to a maximum at the radially outermost edge thereof.

5. A rotor assembly as defined in claim 4 wherein said rotor body includes a web portion which extends between the radially outer portions of adjacent said pumping portions to form the bottom of the associated said groove.

6. In apparatus for pulping liquid slurry stock, the combination of (a) a cylindrical tub for receiving a quantity of stock, (b) said tub having a bottom wall comprising a plane center portion and an annular perforate extraction plate surrounding an adjacent said plane center portion, (c) a rotor body including a hub portion and a plurality of composite vanes projecting outwardly from said hub portion in circumferentially spaced relation, (d) means mounting said rotor body for rotation in a predetermined direction in centered and closely spaced relation with said horizontal portion of said bottom wall, (e) each of said composite vanes including a defibering portion and a pumping portion, (f) said defibering portion constituting the radially outer end portion of said vane and having substantially smaller axial dimensions than said hub portion, (g) means forming an essentially plane leading face on each said defibering vane portion extending tangentially of said rotor body in said direction of rotation from a radius to the radially outer end thereof and defining with said radius an angle *a* of substantially less than 45°, (h) said leading face being forwardly inclined to define an angle of less than 90° with said extraction plate, (i) said pumping portion constituting the upper portion of each said composite vane but being of substantially lesser radial dimensions and substantially greater axial dimensions than said defibering portion, (j) means forming a leading face on each said pumping portion of such configuration as viewed axially of said rotor body that the angle *b* defined by a radius and a tangent to the outer end thereof is sufficiently larger than said angle *a* to promote efficient vortical circulation of the stock, (k) said leading face on each of said pumping portions being essentially plane in axial section and forwardly inclined into partially overhanging relation with the forwardly adjacent said pumping portion to define therewith a groove in the upper surface of said body, (l) said rotor being dimensioned to provide spaces between adjacent said vanes extending substantially the full radial dimension of said extraction plate, and (m) said defibering vane portions being substantially equal in diameter to said extraction plate to extend fully thereacross.

7. Apparatus as defined in claim 6 wherein said extraction plate is frustoconical, the bottom surface of said rotor body is plane over the portion thereof radially inwardly of said spaces between adjacent said vanes and overlying said plane center portion of said tub bottom wall, and the bottom surface of each of said defibering vane portions is tilted upwardly at substantially the same angle as and in overlying relation with said frustoconical extraction plate.

8. Apparatus as defined in claim 7 wherein said frustoconical extraction plate defines an angle of the order of 15° with a radial plane through the axis of said rotor.

9. Apparatus as defined in claim 7 wherein the upper surface of each of said pumping vane portions has a convex curvature of airfoil configuration from the upper edge of said leading face thereof to a minimum axial dimension at the radially outer end of the trailing edge thereof.

10. Apparatus as defined in claim 7 wherein the upper surface of each of said defibering vane portions varies from a maximum axial dimension along the leading edge thereof to a minimum axial dimension along the trailing edge thereof which substantially matches the minimum axial dimension of the adjacent said pumping portion, and wherein said leading face of each of said defibering portions forms a continuation of said leading face on the associated said pumping portion and is similarly forwardly inclined.

* * * * *

UNITED STATES PATENT AND TRADEMARK OFFICE

CERTIFICATE OF CORRECTION

PATENT NO. : 4,109,872

DATED : August 29, 1978

INVENTOR(S) : Joseph Walter Couture

It is certified that error appears in the above-identified patent and that said Letters Patent are hereby corrected as shown below:

Column 2, line 51, "surrounded" has been misspelled.

Column 3, line 22, "as to" should be --as so--.

Column 4, line 41, "its standpoint" should be --this standpoint--.

Column 4, line 48, "as radius" should be --a radius--.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*